US012392571B2

(12) United States Patent
Maugham

(10) Patent No.: US 12,392,571 B2
(45) Date of Patent: Aug. 19, 2025

(54) FIREARM WITH AMBIDEXTROUS BOLT CATCH

(71) Applicant: Christopher Matthew Maugham, Atlantis, FL (US)

(72) Inventor: Christopher Matthew Maugham, Atlantis, FL (US)

( * ) Notice: Subject to any disclaimer, the term of this patent is extended or adjusted under 35 U.S.C. 154(b) by 45 days.

(21) Appl. No.: 18/442,319

(22) Filed: Feb. 15, 2024

(65) Prior Publication Data

US 2025/0012533 A1 Jan. 9, 2025

Related U.S. Application Data

(60) Provisional application No. 63/451,319, filed on Mar. 10, 2023.

(51) Int. Cl.
*F41A 17/36* (2006.01)
*F41A 35/06* (2006.01)

(52) U.S. Cl.
CPC ..... *F41A 17/36* (2013.01); *F41A 35/06* (2013.01)

(58) Field of Classification Search
CPC ..... F41A 17/36; F41A 35/06
See application file for complete search history.

(56) References Cited

U.S. PATENT DOCUMENTS 4,521,985 A * 6/1985 Smith ..... F41A 17/38 42/7
4,759,144 A * 7/1988 Egan ..... F41A 35/06 42/7
5,519,954 A * 5/1996 Garrett ..... F41A 17/38 42/6
7,661,219 B1 * 2/2010 Knight, Jr. ..... F41A 3/42 89/138
8,327,749 B2 * 12/2012 Underwood ..... F41A 17/42 89/190
8,359,966 B1 * 1/2013 Brotherton ..... F41A 17/36 89/181
9,651,328 B1 * 5/2017 Oglesby ..... F41A 35/06
10,030,924 B1 * 7/2018 Smith ..... F41A 17/36
10,393,468 B2 8/2019 Maugham
10,753,696 B1 * 8/2020 Christopher ..... F41A 17/42
11,512,920 B1 * 11/2022 Oglesby ..... F41A 17/42
11,536,531 B1 * 12/2022 Geissele ..... F41A 35/06
(Continued)

*Primary Examiner* — Joshua E Freeman

(74) *Attorney, Agent, or Firm* — Bennet K. Langlotz; Langlotz Patent & Trademark Works, LLC

(57) ABSTRACT

A firearm with ambidextrous bolt catch has a frame, a bolt catch connected to the frame and movable between a retracted position and a restraint position, the bolt catch having exposed interface surfaces on a first side of the frame and configured to enable user contact to motivate the bolt catch to the retracted position and the restraint position, a secondary bolt catch interface assembly operable to motivate the bolt catch to the retracted position and to the restraint position, the secondary bolt catch interface assembly including an actuator having an actuation surface on a second side of the frame, and the actuator operable to move the bolt catch from the restraint position to the retracted position in response to a first actuation effort, and to move the bolt catch from the retracted position to the restraint position in response to a different second actuation effort.

10 Claims, 13 Drawing Sheets

(56) References Cited

U.S. PATENT DOCUMENTS

| | | | | |
|---|---|---|---|---|
| 2010/0275485 | A1* | 11/2010 | Findlay | F41A 35/06 42/16 |
| 2012/0167424 | A1* | 7/2012 | Gomez | F41A 35/06 42/14 |
| 2016/0258696 | A1* | 9/2016 | Fluhr | F41A 3/42 |
| 2017/0284761 | A1* | 10/2017 | Lewis | F41A 17/36 |
| 2019/0093978 | A1* | 3/2019 | Maugham | F41A 17/36 |
| 2021/0180900 | A1* | 6/2021 | Markut | F41A 3/72 |

* cited by examiner

FIREARM WITH AMBIDEXTROUS BOLT CATCH

CROSS-REFERENCE TO RELATED APPLICATION

This application claims the benefit of U.S. Provisional Patent Application No. 63/451,319 filed on Mar. 10, 2023, entitled "AMBIDEXTROUS BOLT CATCH MECHANISM," which is hereby incorporated by reference in its entirety for all that is taught and disclosed therein.

FIELD OF THE INVENTION

The present invention relates to firearms, and more particularly to a firearm with ambidextrous bolt catch that enables the bolt catch to be operated with either hand.

BACKGROUND AND SUMMARY OF THE INVENTION

Semi-automatic and automatic firearms after being discharged automatically eject a spent round, load a new round in a firing chamber, and cock a firing pin without any additional steps being carried out by the person shooting the firearm after the trigger is pulled. Often, spring-loaded magazines or clips of ammunition are used by semi-automatic and automatic firearms to supply another round for the bolt carrier assembly to feed into the firing chamber after a spent round has been ejected. When all of the rounds of the magazine have been used, the magazine can be disengaged from the firearm, and another magazine holding live ammunition can be inserted into the firearm so shooting can resume.

While the procedure to disengage an empty magazine from a firearm can vary widely between different styles of firearms, many firearm manufacturers have developed a spring-loaded mechanism positioned on one side of the firearm that, when activated, releases a mechanical device retaining the magazine in the firearm. This mechanical retaining device advantageously holds the magazine of ammunition in the firearm so movement of the firearm and forces placed upon the firearm during practice or combat will not unexpectedly cause the magazine to detach from the firearm. The magazine release mechanism allows the mechanical retaining device to securely hold the magazine while providing a means to quickly release the retaining device so the magazine can be removed when empty and replaced with another magazine loaded with ammunition. In some firearms, when the magazine release mechanism is activated, the magazine will drop from the firearm due to gravity when the firearm is oriented in a substantially horizontal position with the magazine facing downward.

A frequent problem with the process of rapidly firing firearms using spring-loaded magazines of ammunition is the occurrence of jams during the ejection and feeding cycles. Jams often occur because a round is not correctly ejected or loaded into the firing chamber, or when multiple rounds are simultaneously fed from the magazine toward the firing chamber. When a firearm jams, the jam must be cleared before the firearm is operational again. In many firearms, clearing a jam requires multiple steps that require both hands of an operator.

For example, clearing a jam on an automatic or semi-automatic rifle for a right-handed operator may require the steps of:

a) removing left hand from firing position on barrel hand guard.
b) grasping the front of the magazine well with the left hand and placing the left thumb on the bolt catch to rotate it to the locked position.
c) removing the right hand from the firing grip.
d) pulling the charging handle to the rear with the right hand until the bolt locks.
c) returning the right hand to the grip.
f) pushing the magazine release button with the index finger of the right hand while removing the magazine with the left hand.
g) grasping the front of the magazine well again with the left hand.
h) running the charging handle three times with the right hand.
i) locking the bolt to the rear with the left hand on the third pull of the charging handle.
j) returning the right hand to the firing grip.
k) retrieving and inserting a loaded magazine with the left hand.
l) pressing the bolt release with the left hand.
m) returning the left hand to the firing position on the barrel hand guard.

While this standard process effectively clears jams in the chamber of the firearm, the process has a few problems. For example, in combat situations, the configuration of the firearm requires an operator to remove his or her right hand (the trigger hand) from the firing grip twice to pull the bolt back and charge the firearm during this standard clearing process. Removing the right hand slows down the clearing process and may be less safe because the right hand is displaced from the firing grip. Here, the time required to clear the jam may leave one defenseless long enough to be shot by an attacker. Additionally, in newer operators, the removal of the right hand may result in less control of the firearm. That is, instead of controlling the positioning of the firearm, including maintaining a safe direction of directing the barrel of the firearm, by maintaining contact on the firing grip, the current configuration of the firearm and standard clearing process lends itself to more careless control of the firing direction of the firearm in newer users.

For a left-handed operator, the jam clearing process may consist of the steps of:

a) placing the left-hand index finger on the bolt catch.
b) removing right hand from firing position on the barrel hand guard.
c) pulling the charging handle to the rear with the right hand until the bolt locks.
d) pushing the magazine release button with the thumb of the right hand while removing the magazine by grasping it with the remaining fingers of the right hand.
e) running the charging handle three times with the right hand.
f) locking the bolt to the rear with the left-hand index finger on the third time.
g) retrieving and inserting a loaded magazine with the right hand.
h) returning the right hand to the firing position on the barrel hand guard.
i) removing the left hand from the firing grip.
j) pressing the bolt release with the left-hand thumb.
k) returning the left hand to the firing grip.

The process for the left-handed shooter has fewer steps, but still requires repositioning of the left hand twice due to the force required to operate the bolt release being too great for the left index finger to perform.

Therefore, a need exists for a new and improved firearm with ambidextrous bolt catch that enables the bolt catch to be operated with either hand. In this regard, the various embodiments of the present invention substantially fulfill at least some of these needs. In this respect, the firearm with ambidextrous bolt catch according to the present invention substantially departs from the conventional concepts and designs of the prior art, and in doing so provides an apparatus primarily developed for the purpose of enabling the bolt catch to be operated with either hand.

The present invention provides an improved firearm with ambidextrous bolt catch, and overcomes the above-mentioned disadvantages and drawbacks of the prior art. As such, the general purpose of the present invention, which will be described subsequently in greater detail, is to provide an improved firearm with ambidextrous bolt catch that has all the advantages of the prior art mentioned above.

To attain this, the preferred embodiment of the present invention essentially comprises a frame having opposed first and second sides and defining a bolt passage receiving a reciprocating bolt operable to move between a forward position and a rear position, a bolt catch connected to the frame and movable between a retracted position in which the reciprocating bolt freely moves from the rear position to the forward position, and a restraint position in which the reciprocating bolt is retained in the rear position, the bolt catch having exposed interface surfaces on the first side of the frame and configured to enable user contact to motivate the bolt catch to the retracted position and the restraint position, a secondary bolt catch interface assembly operable to motivate the bolt catch to the retracted position and to the restraint position, the secondary bolt catch interface assembly including an actuator having an actuation surface on the second side of the frame, and the actuator operable to move the bolt catch from the restraint position to the retracted position in response to a first actuation effort, and to move the bolt catch from the retracted position to the restraint position in response to a different second actuation effort. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
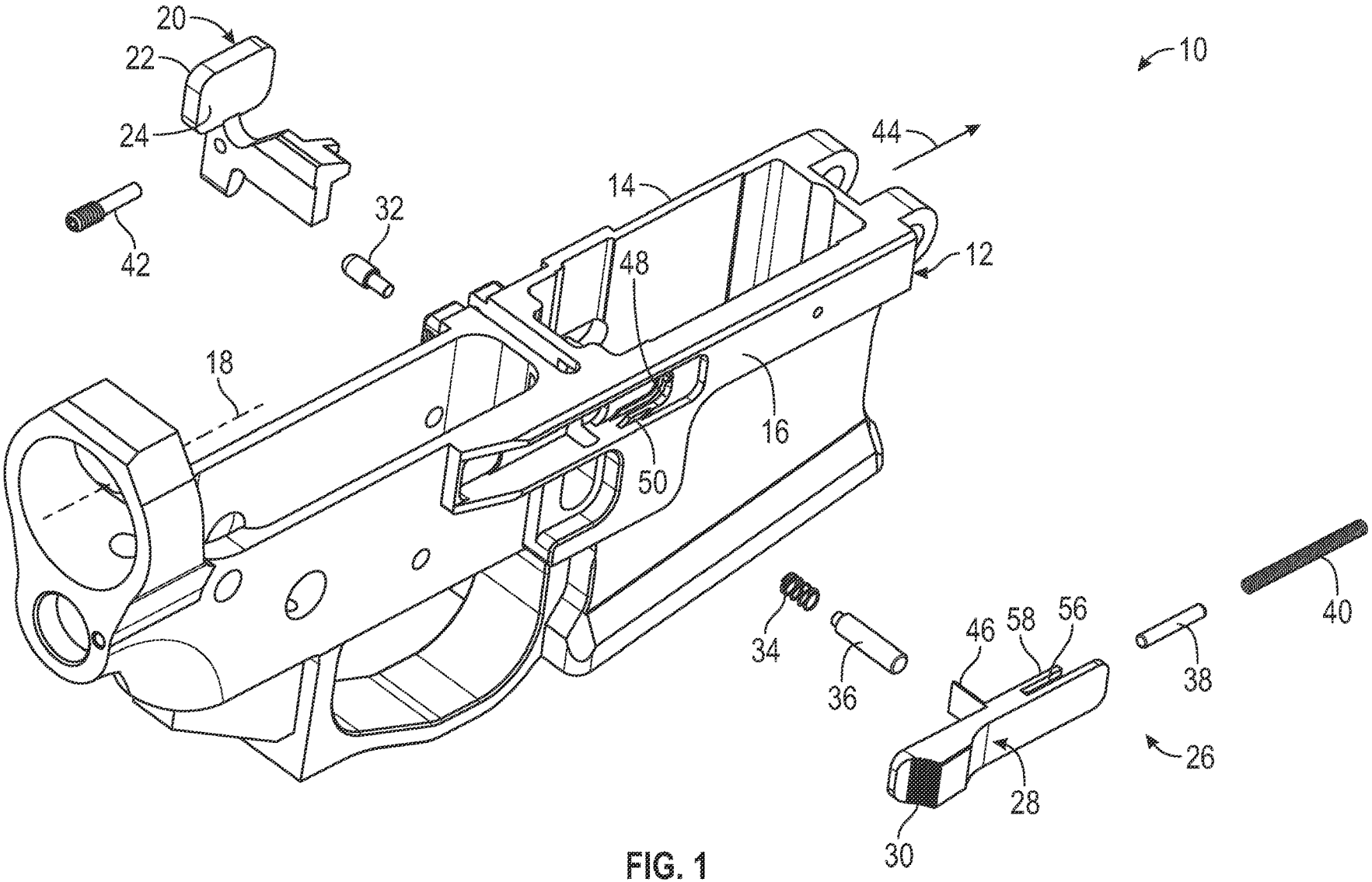
FIG. 1 is an exploded view of the current embodiment of a firearm with ambidextrous bolt catch constructed in accordance with the principles of the present invention.

An embodiment of the firearm with ambidextrous bolt catch of the present invention is shown and generally designated by the reference numeral 10.

Figure 2:
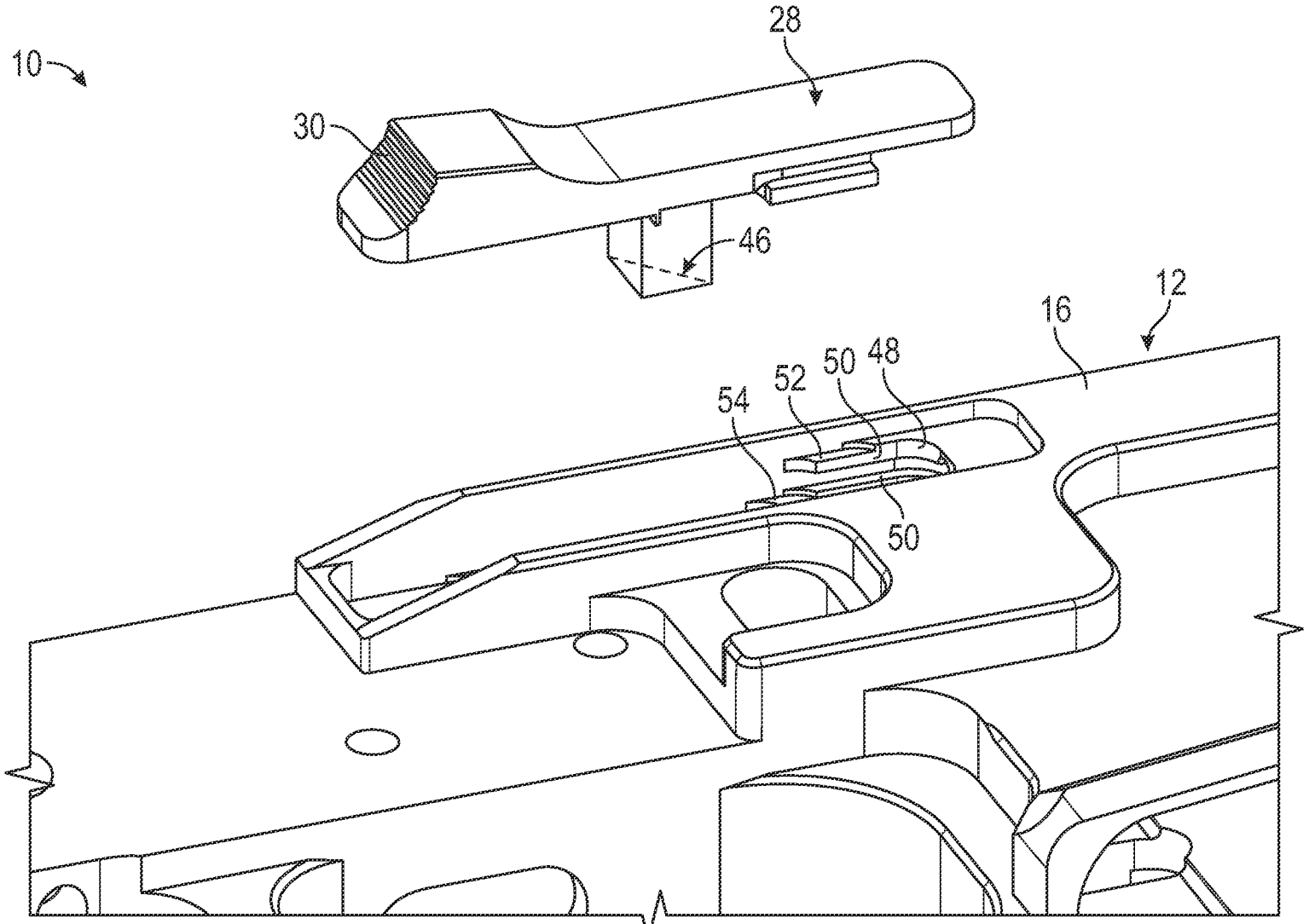
FIG. 2 is an enlarged partial exploded view of the firearm with ambidextrous bolt catch of FIG. 1.
Figure 3A:
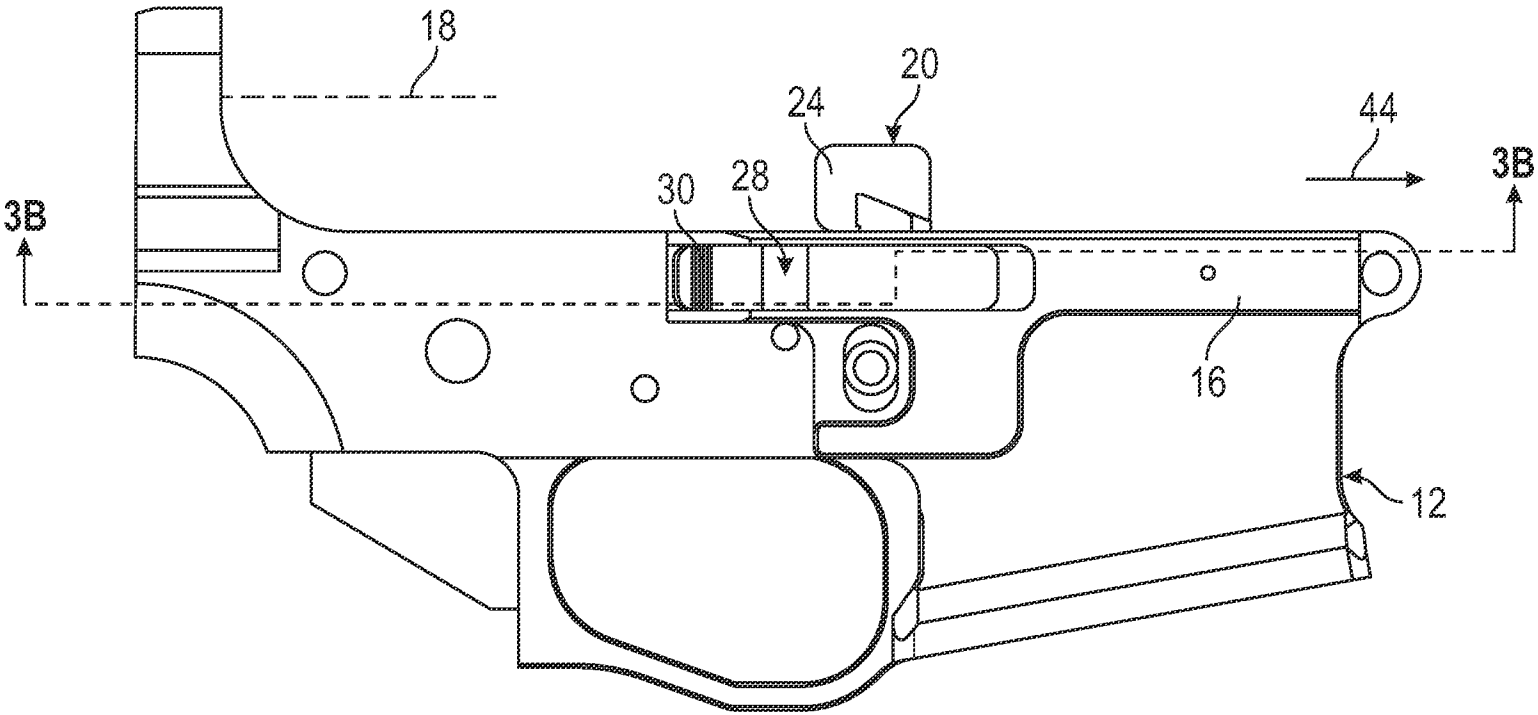
FIG. 3A is a right side view of the frame of the firearm with ambidextrous bolt catch of FIG. 1 with the bolt catch in the retracted position and the actuator in the relaxed condition.
Figure 3B:
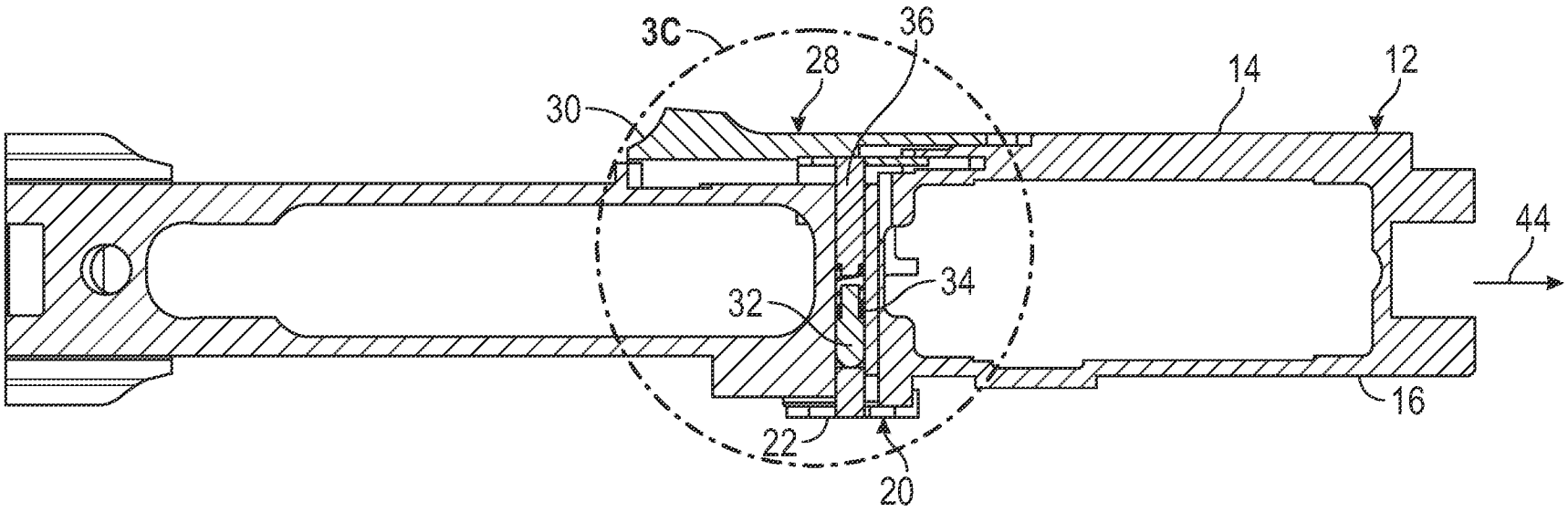
FIG. 3B is a bottom sectional view of the frame of the firearm with ambidextrous bolt catch taken along line 3B-3B of FIG. 3A with the bolt catch in the retracted position and the actuator in the relaxed condition.
Figure 3C:
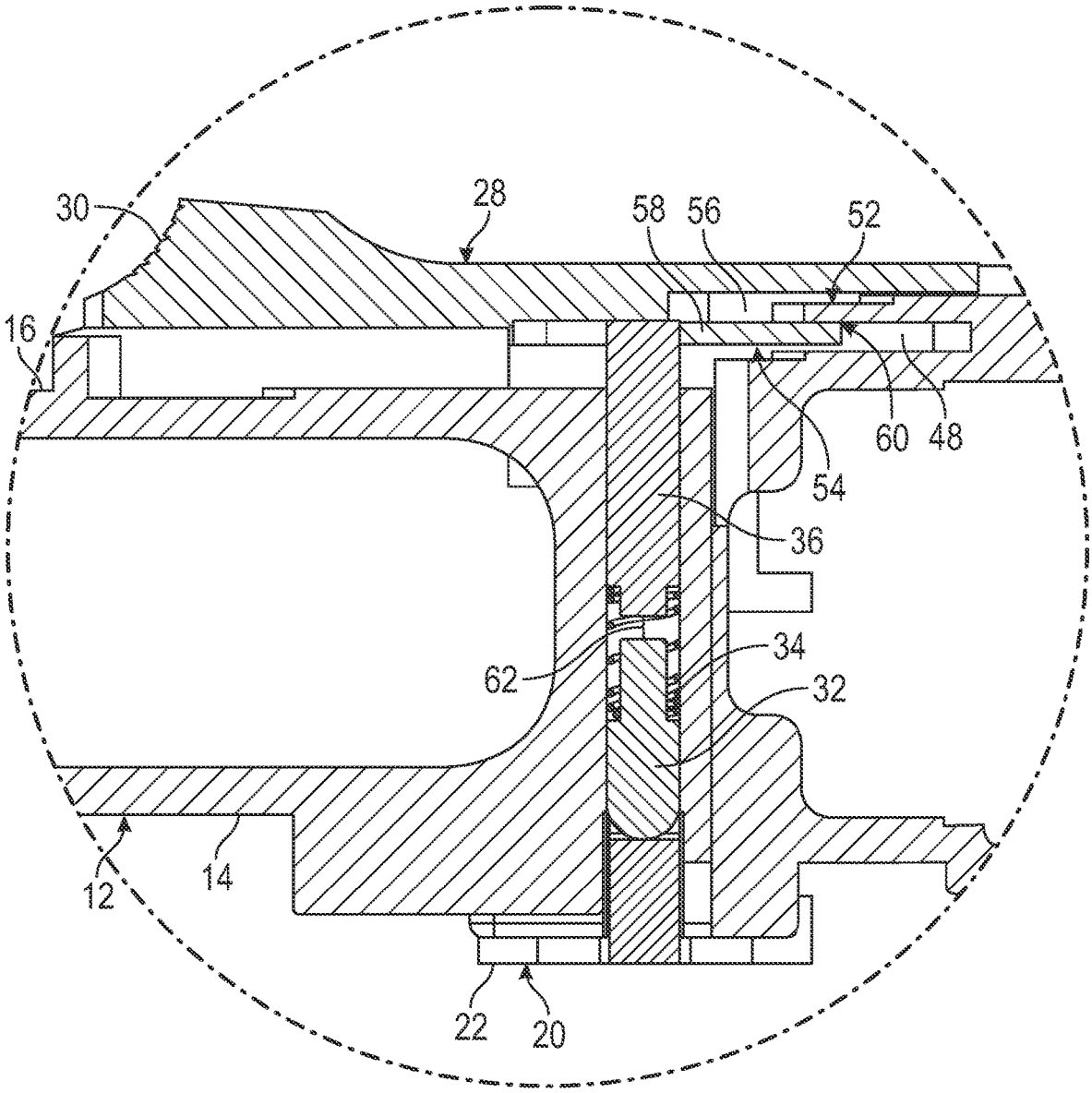
FIG. 3C is an enlarged partial view of the frame of the firearm with ambidextrous bolt catch taken along circle 3C of FIG. 3B with the bolt catch in the retracted position and the actuator in the relaxed condition.
Figure 3D:
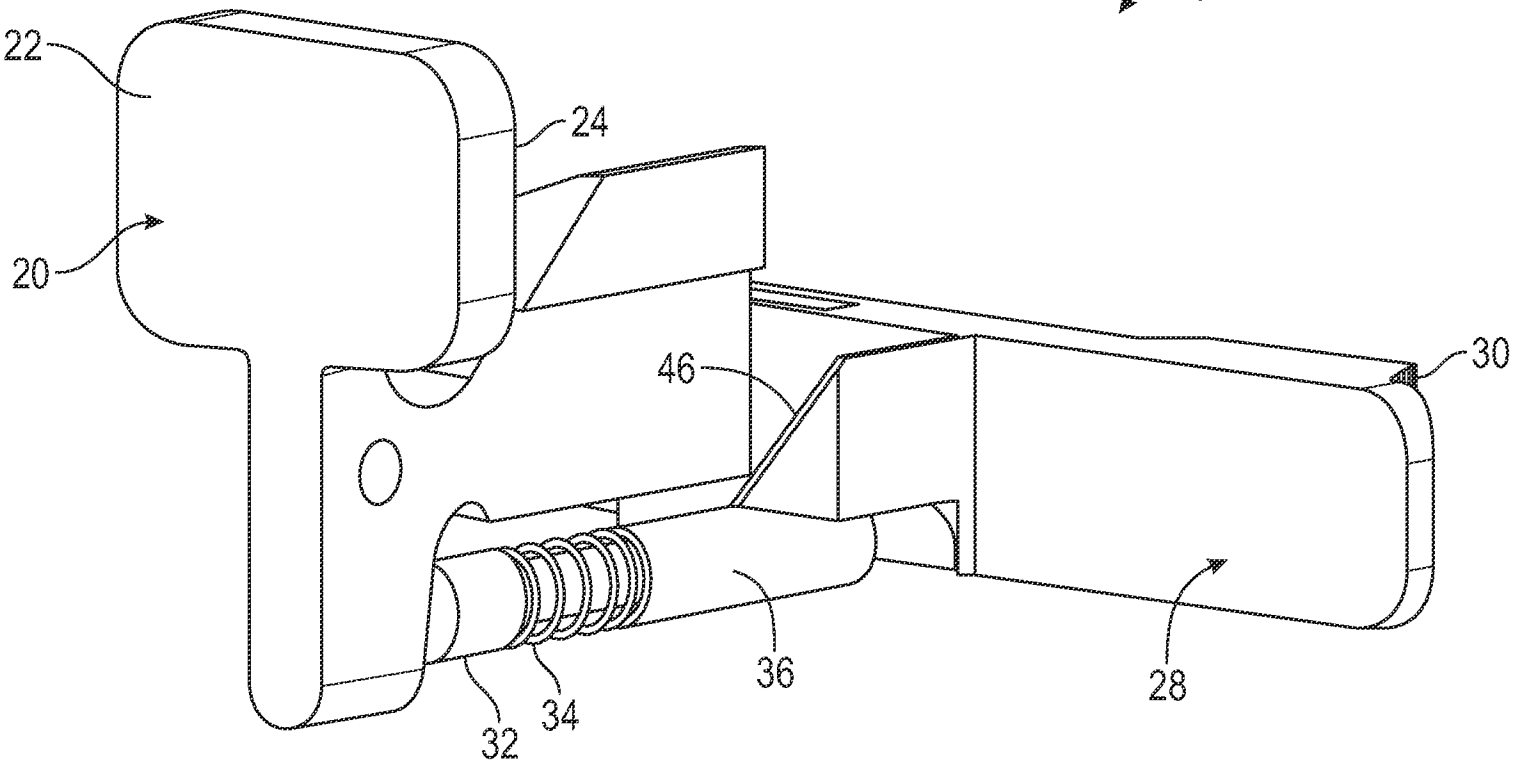
FIG. 3D is an isometric view of the bolt catch and secondary bolt catch interface assembly of the firearm with ambidextrous bolt catch of FIG. 1 with the bolt catch in the retracted position and the actuator in the relaxed condition.

FIGS. 1 & 2 illustrate the improved firearm with ambidextrous bolt catch 10 of the present invention. More particularly, the firearm with ambidextrous bolt catch has a frame 12 having opposed first and second sides 14, 16 and defining a bolt passage 18 receiving a reciprocating bolt (not shown) operable to move between a forward position and a rear position. A bolt catch 20 is connected to the first side of the frame by a bolt catch pin 42. The bolt catch is movable between a retracted position in which the reciprocating bolt freely moves from the rear position to the forward position, and a restraint position in which the reciprocating bolt is retained in the rear position. The bolt catch has exposed first and second interface surfaces 22, 24 on the first side of the frame, which are configured to enable user contact to motivate the bolt catch to the retracted position and the restraint position.

A secondary bolt catch interface assembly 26 is operable to motivate the bolt catch 20 to the retracted position and to the restraint position. The secondary bolt catch interface assembly includes an actuator 28 having an actuation surface 30 on the second side 16 of the frame 12. The actuator defines an actuator way 56 and an actuator rail 58 that interact with a frame way 48 and a stepped frame rail 50 to define a range of motion of the actuator with respect to the second side of the frame. The movement of the actuator is perpendicular to the actuator movable in a first direction parallel to the second side, and in a second direction perpendicular to the second side. The stepped frame rail defines clearance portions 52, 54 to enable pivoting of the actuator. The actuator also includes a ramp 46 configured to elevate a portion of the bolt catch in response to movement of the actuator.

The actuator 28 is operable to move the bolt catch 20 from the restraint position to the retracted position in response to a first actuation effort, and to move the bolt catch from the retracted position to the restraint position in response to a different second actuation effort. The actuator is spring-biased rearward to the relaxed condition by an actuator return detent spring 40 acting on an actuator return detent 38. The secondary bolt catch interface assembly also includes an actuator detent 36, a bolt catch detent 32, and a bolt catch detent spring 34 located between the bolt catch detent and the actuator detent to enable the actuator to interact with the bolt catch.

In the current embodiment, the first actuation effort and the second actuation effort are in different directions. The first actuation effort and the second actuation effort are preferably in perpendicular directions. The firearm defines a forward direction (arrow 44) associated with a direction of shooting. One of the first actuation effort and second actuation effort is in the forward direction, and the other of the first actuation effort and second actuation effort is in a direction toward the frame. The other of the first actuation effort and second actuation effort is preferably perpendicular to the second side 16 of the frame. In a preferred embodiment, the first actuation effort operates to pivot the actuator, and the second actuation effort operates to translate the actuator.

FIGS. 3A-3D illustrate the improved firearm with ambidextrous bolt catch 10 of the present invention. More particularly, the bolt catch 20 is in the retracted position, and the actuator 28 is in the relaxed condition. The bolt catch is spring-biased to the retracted position by the bolt catch detent spring 34 acting on the bolt catch detent 32. The actuator is spring-biased to the relaxed condition by the actuator return detent spring 40 acting on the actuator return detent 38 and the bolt catch detent spring also acting on the actuator detent 36. The bolt catch detent spring maintains a gap 62 between the actuator return detent and the bolt catch detent. In this condition, the firearm with ambidextrous bolt catch 10 is free to operate normally while there is at least one cartridge in the loaded magazine to prevent the follower in the magazine (not shown) from raising the bolt catch to the restraint position.

Figure 4A:
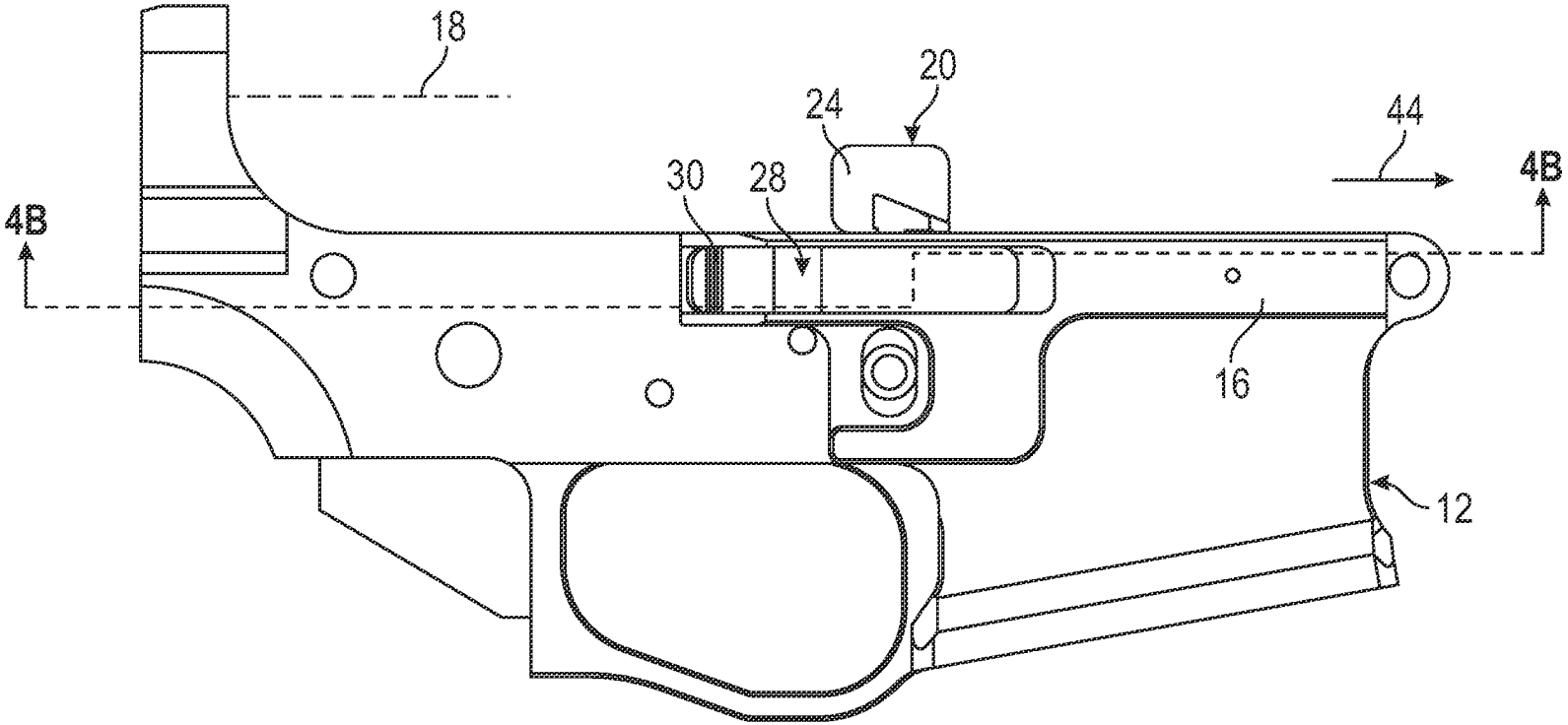
FIG. 4A is a right side view of the frame of the firearm with ambidextrous bolt catch of FIG. 1 with the bolt catch in the retracted position and the actuator in the pivoted condition.
Figure 4B:
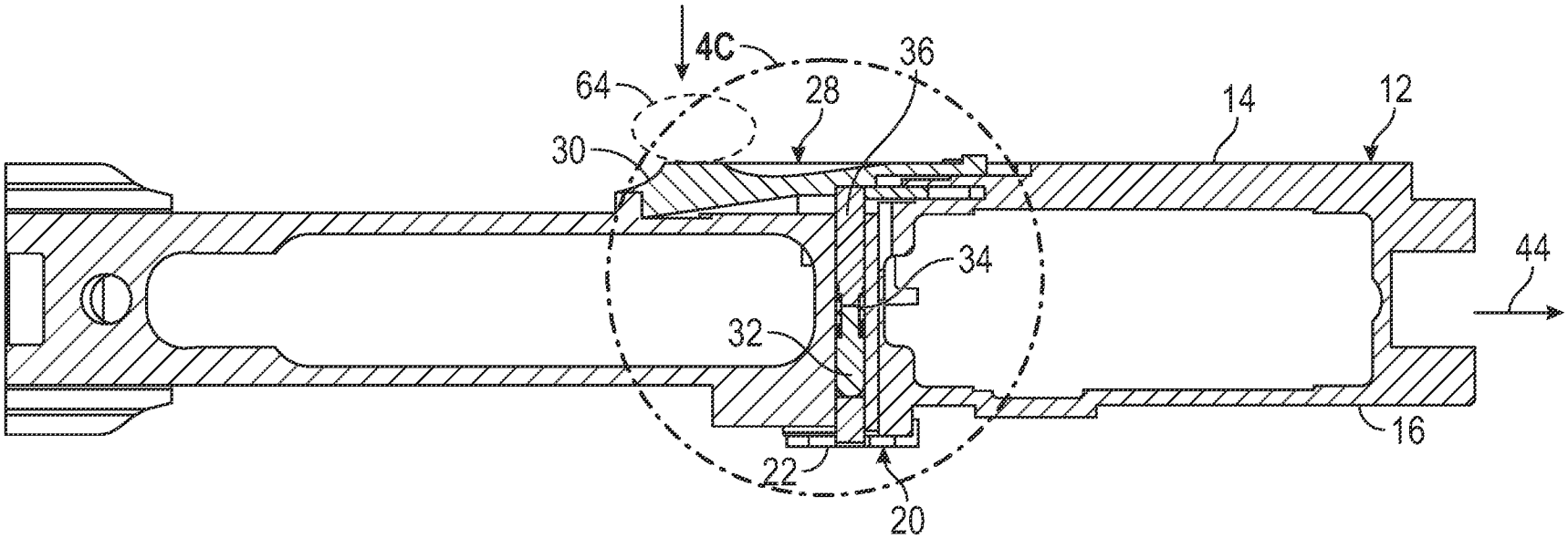
FIG. 4B is a bottom sectional view of the frame of the firearm with ambidextrous bolt catch taken along line 4B-4B of FIG. 3A with the bolt catch in the retracted position and the actuator in the pivoted condition.
Figure 4C:
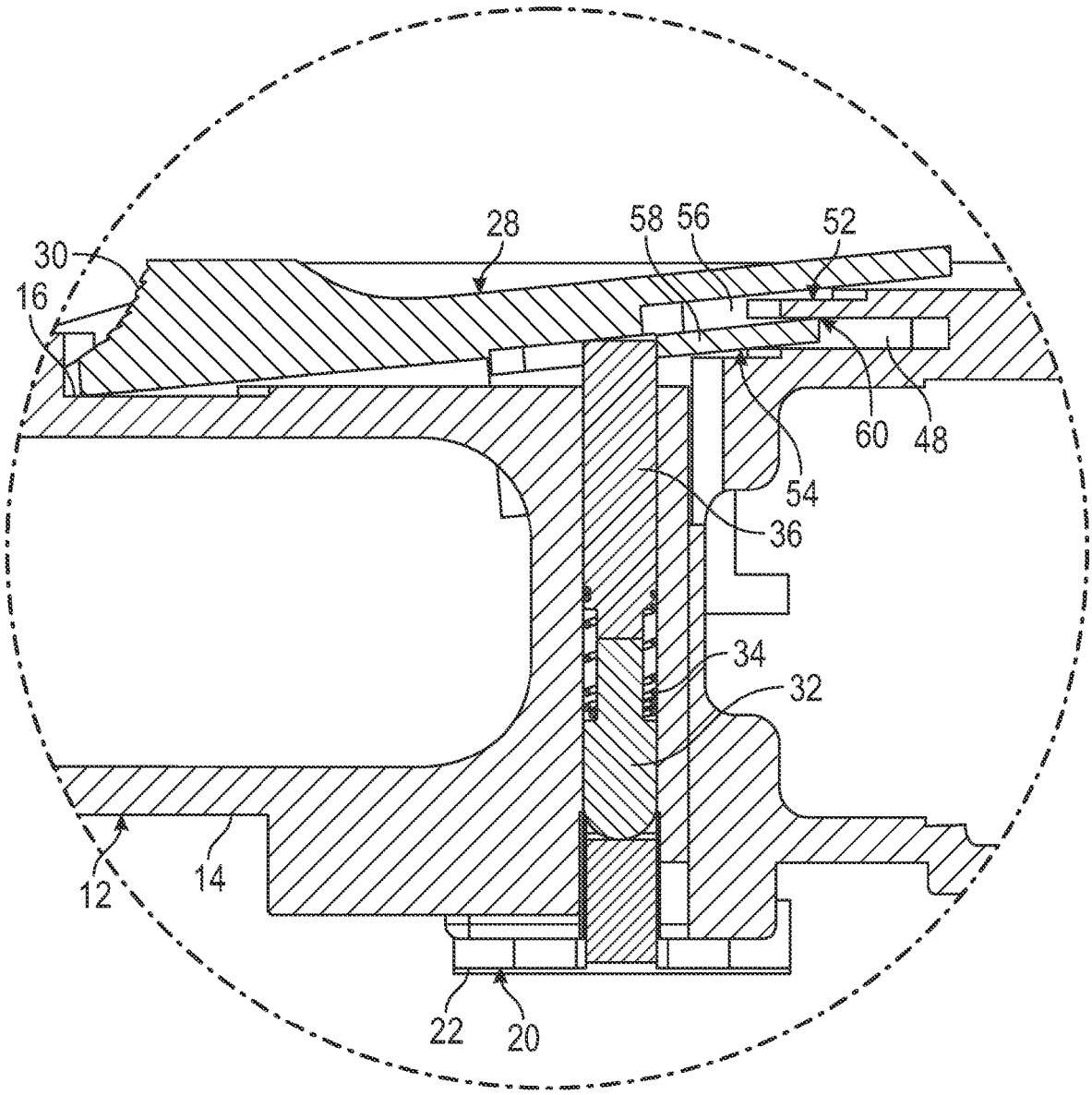
FIG. 4C is an enlarged partial view of the frame of the firearm with ambidextrous bolt catch taken along circle 4C of FIG. 4B with the bolt catch in the retracted position and the actuator in the pivoted condition.
Figure 5A:
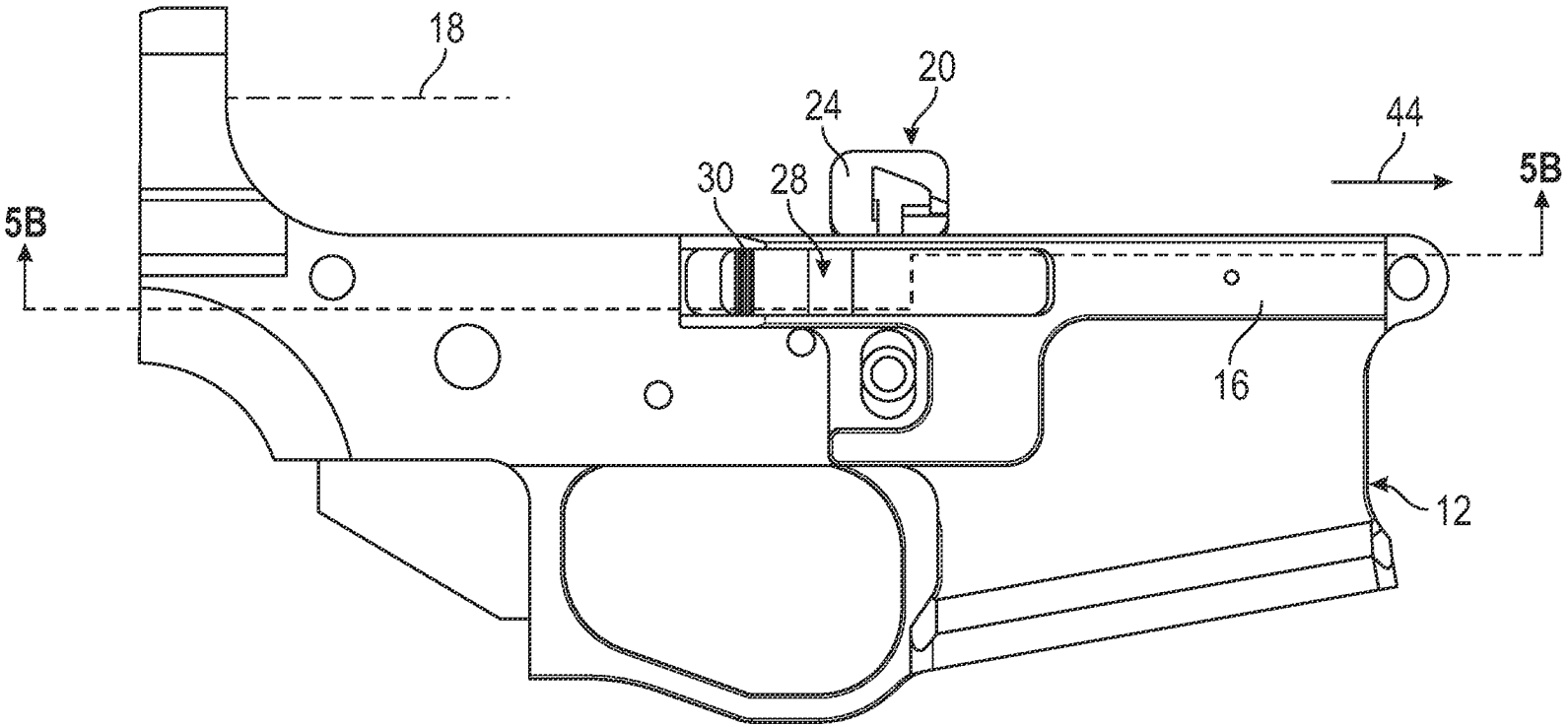
FIG. 5A is a right side view of the frame of the firearm with ambidextrous bolt catch of FIG. 1 with the bolt catch in the restraint position and the actuator in the translated forward condition.
Figure 5B:
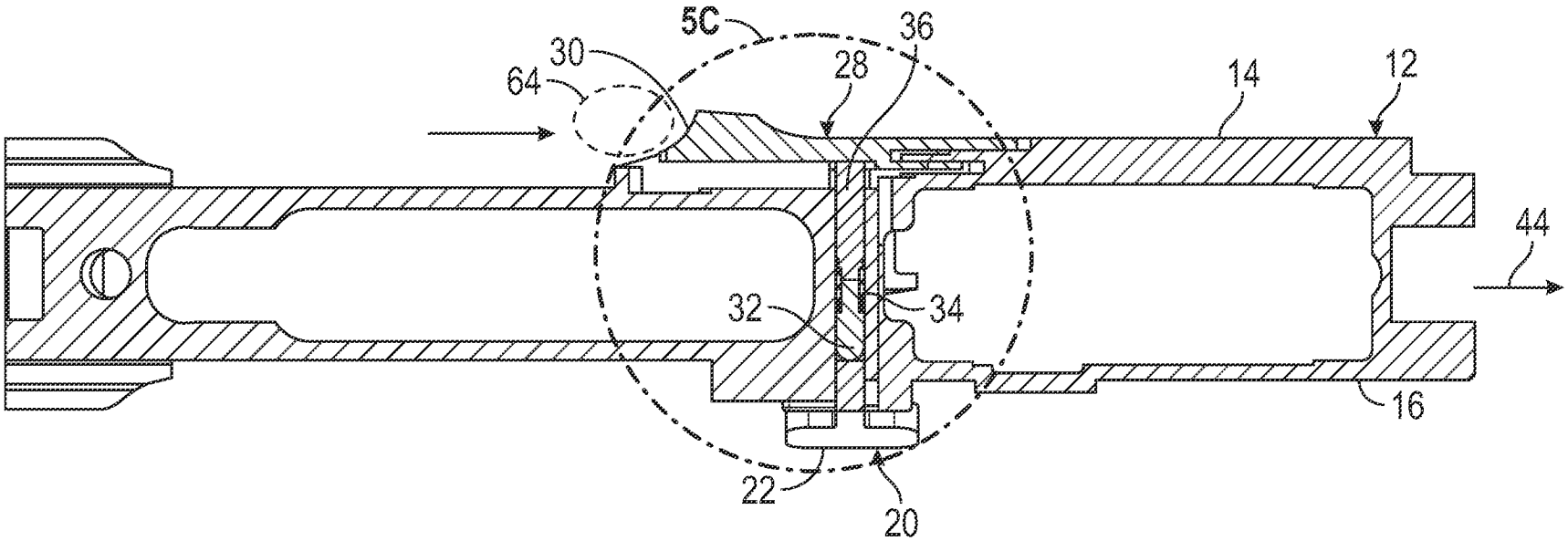
FIG. 5B is a bottom sectional view of the frame of the firearm with ambidextrous bolt catch taken along line 5B-5B of FIG. 5A with the bolt catch in the restraint position and the actuator in the translated forward condition.
Figure 5C:
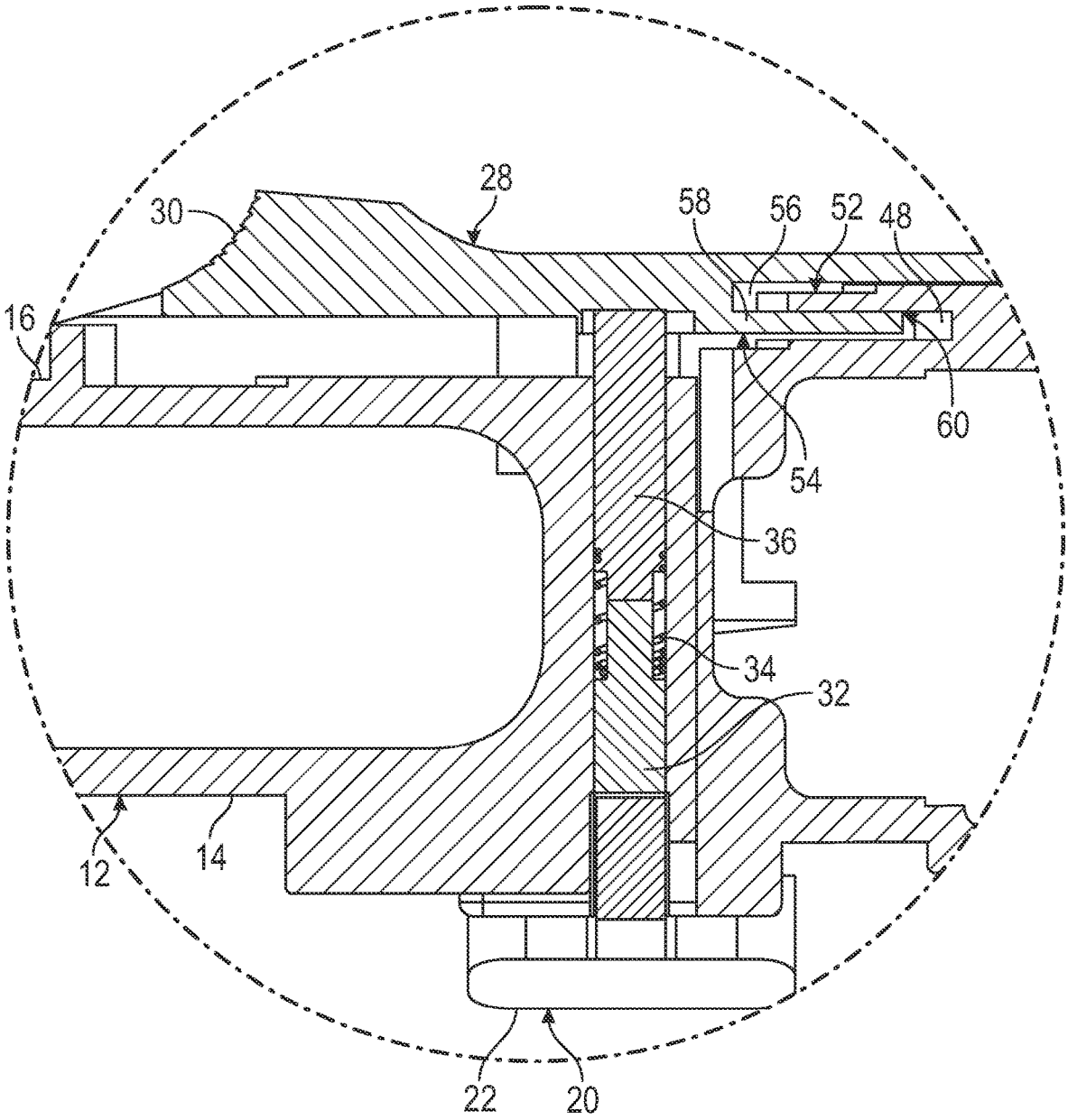
FIG. 5C is an enlarged partial view of the frame of the firearm with ambidextrous bolt catch taken along circle 5C of FIG. 5B with the bolt catch in the restraint position and the actuator in the translated forward condition.
Figure 5D:
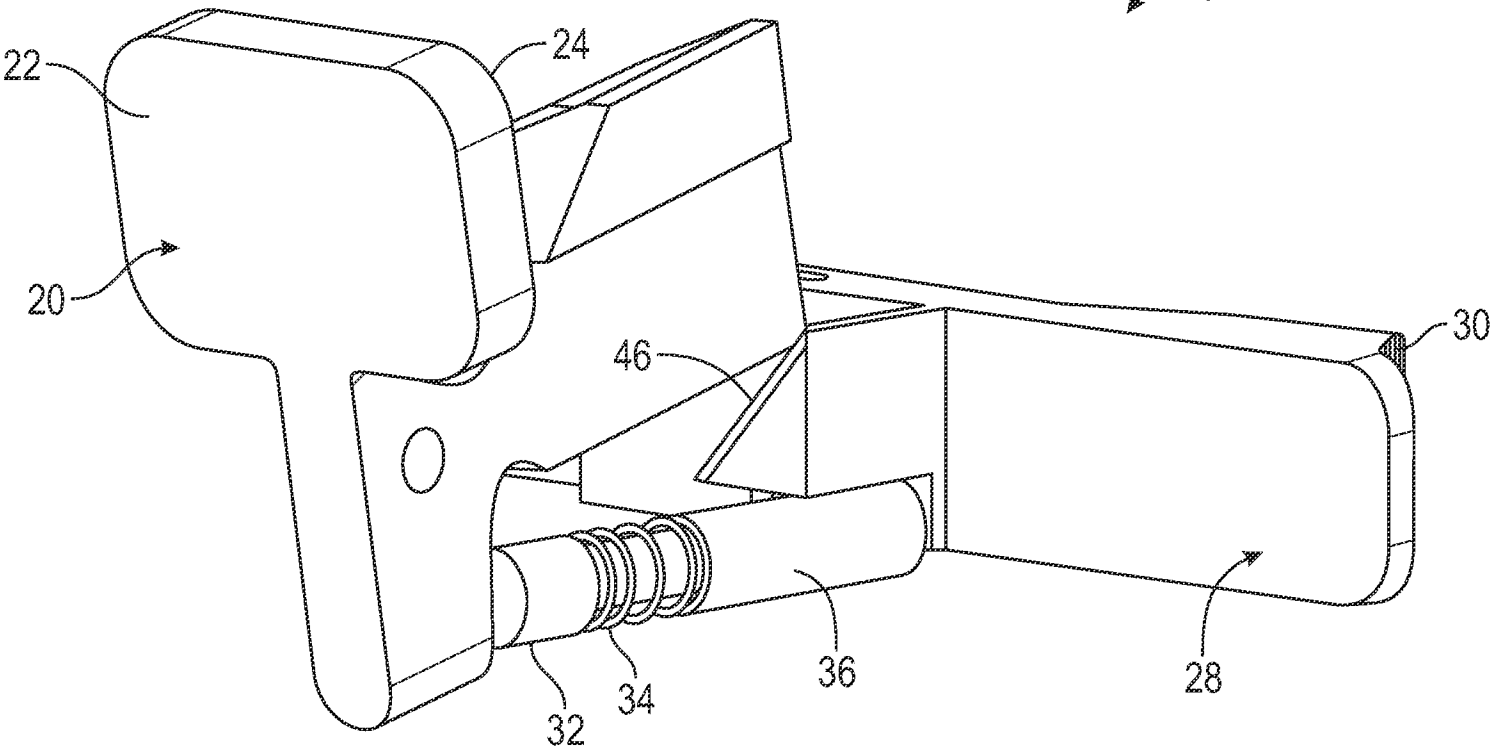
FIG. 5D is an isometric view of the bolt catch and secondary bolt catch interface assembly of the firearm with ambidextrous bolt catch of FIG. 1 with the bolt catch in the restraint position and the actuator in the translated forward condition.

FIGS. 4A-4C illustrate the improved firearm with ambidextrous bolt catch 10 of the present invention. More particularly, the actuator 28 is in the pivoted condition having experienced a first actuation effort by the user's finger 64 pivot about a pivot point 60. When actuator 28 is in the pivoted condition, the actuator detent 36 compresses bolt catch detent spring 34 to close gap 62 and contact the bolt catch detent 32. The bolt catch detent pushes against the bolt catch 20 to release the bolt catch from the restraint position to the retracted position. This action unlocks the reciprocating bolt (not shown) and enables the reciprocating bolt to return forward to the in-battery condition.

FIGS. 5A-5D illustrate the improved firearm with ambidextrous bolt catch 10 of the present invention. More particularly, the bolt catch 20 is in the restraint position, and the actuator 28 is in the translated forward condition. As the user's finger applies forward pressure to the actuation surface 30 of the actuator 28, the ramp 46 on the actuator engages with the bolt catch 20 and rotates the bolt catch into the restraint position to lock the reciprocating bolt (not shown) to the rear. Rotation of the bolt catch pushes the bolt catch detent 32 towards the actuator detent 36 and compresses the bolt catch detent spring 34 to close the gap 62 between the actuator detent and the bolt catch detent. When the user releases the actuator, the actuator return detent spring 40 acts on the actuator return detent 38 to return the actuator to the rearward relaxed condition. The user can then pivot the actuator as shown in FIGS. 4A-4C to release the bolt catch from the restraint position to the retracted position and unlock the reciprocating bolt.

It should be appreciated that the current invention provides the ability to manipulate the bolt catch from the opposite side of the frame from the side where the bolt catch is located. While ostensibly appearing to be a form of bolt catch release lever currently marketed by several manufacturers, the present invention differs by allowing complete manipulation of the bolt catch. The current invention enables both engaging and disengaging the bolt catch from the opposite side of the frame, thereby allowing for the fastest and safest manipulation of the firearm. Additionally, the placement and operation of the actuator is ideally suited for natural finger motion, which allows for intuitive use without the need for excessive training or retraining.

The strong hand of the shooter, the right hand for a right-handed person and the left hand for a left-handed person, typically holds a firearm such that the thumb and index finger are free to operate controls. The thumb is adept at both pushing controls towards the centerline of the firearm and operating other controls up and down or rotationally when located on the thumb-side of the firearm, such as safety selector levers. The index finger, however, is best suited to manipulations stemming from the inward curling motion of the finger such as squeezing the trigger or pressing the magazine release button, or outward curling or pointing motions such as ringing a doorbell or pressing a button in an elevator. This is due to anatomical limitations of the structure of the human hand.

There have been a variety of ambidextrous designs brought to market over the past several years. However, all of them require either a significant repositioning of the right hand (for right-hand dominant operators) to reach the right-side controls or awkward, unintuitive, or difficult manipulation due to dexterity limits of the human index finger. In addition, some designs require modifications to, or purpose made, upper receivers to allow for proper operation of their right-side bolt catch controls. In contrast, the current invention is the only one that allows completely independent manipulation of the bolt catch comfortably and intuitively without awkward or time-consuming repositioning of the strong hand while being compatible with any mil-spec upper receiver.

The current invention, which duplicates the bolt catch operation mechanism to the right side, enables the jam clearing process to consist of the steps outlined below. The operator's strong hand operates the fire controls from the firing grip, and the operator's weak hand supports the firearm from the weak hand's position on the barrel hand guard. Compared to the conventional jam clearing processes discussed earlier, the process enabled by the current invention has fewer and simpler steps for operators with either right or left-hand dominance.

a) Placing the strong hand index finger on the bolt catch control.

b) Removing the weak hand from firing position on the barrel hand guard.

c) Pulling the charging handle to the rear with the weak hand until the bolt locks.

d) Pushing the magazine release button with the index finger of the strong hand while removing the magazine with the weak hand.

c) Running the charging handle three times with the weak hand.

f) Locking the bolt to the rear with the strong hand index finger on the third pull of the charging handle.

g) Retrieving and inserting a loaded magazine with the weak hand h) Pressing the bolt release with the weak hand.

i) Returning the weak hand to the firing position on the barrel hand guard.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm with ambidextrous bolt catch has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame having opposed first and second sides and defining a bolt passage receiving a reciprocating bolt operable to move between a forward position and a rear position;

a bolt catch connected to the frame and movable between a retracted position in which the reciprocating bolt freely moves from the rear position to the forward position, and a restraint position in which the reciprocating bolt is retained in the rear position;

the bolt catch having exposed interface surfaces on the first side of the frame and configured to enable user contact to motivate the bolt catch to the retracted position and the restraint position;

a secondary bolt catch interface assembly operable to motivate the bolt catch to the retracted position and to the restraint position;

the secondary bolt catch interface assembly including an actuator having an actuation surface on the second side of the frame; and the actuator operable to move the bolt catch from the restraint position to the retracted position in response to a first actuation effort, and to move the bolt catch from the retracted position to the restraint position in response to a different second actuation effort.

2. The firearm of claim 1 wherein the first actuation effort and the second actuation effort are in different directions.

3. The firearm of claim 1 wherein the first actuation effort and the second actuation effort are in perpendicular directions.

4. The firearm of claim 1 wherein the firearm defines a forward direction associated with a direction of shooting, and wherein one of the first actuation effort and second actuation effort is in the forward direction.

5. The firearm of claim 4 wherein the other of the first actuation effort and second actuation effort is in a direction toward the frame.

6. The firearm of claim 5 wherein the other of the first actuation effort and second actuation effort is perpendicular to the second side of the frame.

7. The firearm of claim 1 wherein the first actuation effort operates to pivot the actuator.

8. The firearm of claim 1 wherein the second actuation effort operates to translate the actuator.

9. The firearm of claim 1 wherein the actuator includes a ramp configured to elevate a portion of the bolt catch in response to movement of the actuator.

10. The firearm of claim 9 wherein the movement of the actuator is perpendicular to the actuator movable in a first direction parallel to the second side, and in a second direction perpendicular to the second side.

* * * * *